US010209032B1

(12) United States Patent
Aguirre

(10) Patent No.: US 10,209,032 B1
(45) Date of Patent: Feb. 19, 2019

(54) FIREARM HOLSTER ASSEMBLY

(71) Applicant: Rene Aguirre, Alamo, TX (US)

(72) Inventor: Rene Aguirre, Alamo, TX (US)

( * ) Notice: Subject to any disclaimer, the term of this patent is extended or adjusted under 35 U.S.C. 154(b) by 0 days.

(21) Appl. No.: 15/701,773

(22) Filed: Sep. 12, 2017

(51) Int. Cl.
*F41C 33/02* (2006.01)
*F41C 33/04* (2006.01)

(52) U.S. Cl.
CPC ..... *F41C 33/041* (2013.01); *F41C 33/0236* (2013.01)

(58) Field of Classification Search
CPC .. F41C 33/041; F41C 33/0236; F41C 33/043; F41C 33/045; F41C 33/006; A45F 2200/0591; A45F 5/02
USPC ..... 224/587
See application file for complete search history.

(56) References Cited

U.S. PATENT DOCUMENTS 5,421,497 A * 6/1995 Gilmore ..... A45F 5/00 224/192
5,467,909 A * 11/1995 Resca ..... F41C 33/0245 224/193
5,544,794 A * 8/1996 Nichols ..... F41C 33/0245 224/198
5,641,102 A * 6/1997 Hellweg ..... A45F 5/00 224/198

* cited by examiner

*Primary Examiner* — Adam J Waggenspack
(74) *Attorney, Agent, or Firm* — Plager Schack LLP; Mark H. Plager; Michael J O'Brien

(57) ABSTRACT

A holster assembly is configured to be worn on a belt. The holster assembly has a holster inner portion, joined to a holster outer portion. The holster outer portion further includes an outer wall that is defined by an outer wall axis. A first clip is joined to the holster inner portion and the holster outer portion. The first clip further comprises a first clip upper portion top portion that is an arc that is extruded along a top portion central axis. An angle measured counterclockwise from the top portion central axis to the outer wall axis is at least five degrees but no more than fifteen degrees.

7 Claims, 3 Drawing Sheets

FIREARM HOLSTER ASSEMBLY

BACKGROUND

The embodiments herein relate generally to firearm accessories.

Prior to embodiments of the disclosed invention there were limited options for properly canting a holster while providing a more efficient method of concealment. Embodiments of the disclosed invention solve this problem.

SUMMARY

A holster assembly is configured to be worn on a belt. The holster assembly has a holster inner portion, joined to a holster outer portion. The holster outer portion further includes an outer wall that is defined by an outer wall axis. A first clip is joined to the holster inner portion and the holster outer portion. The first clip further comprises a first clip upper portion top portion that is an arc that is extruded along a top portion central axis. An angle measured counterclockwise from the top portion central axis to the outer wall axis is at least five degrees but no more than fifteen degrees.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
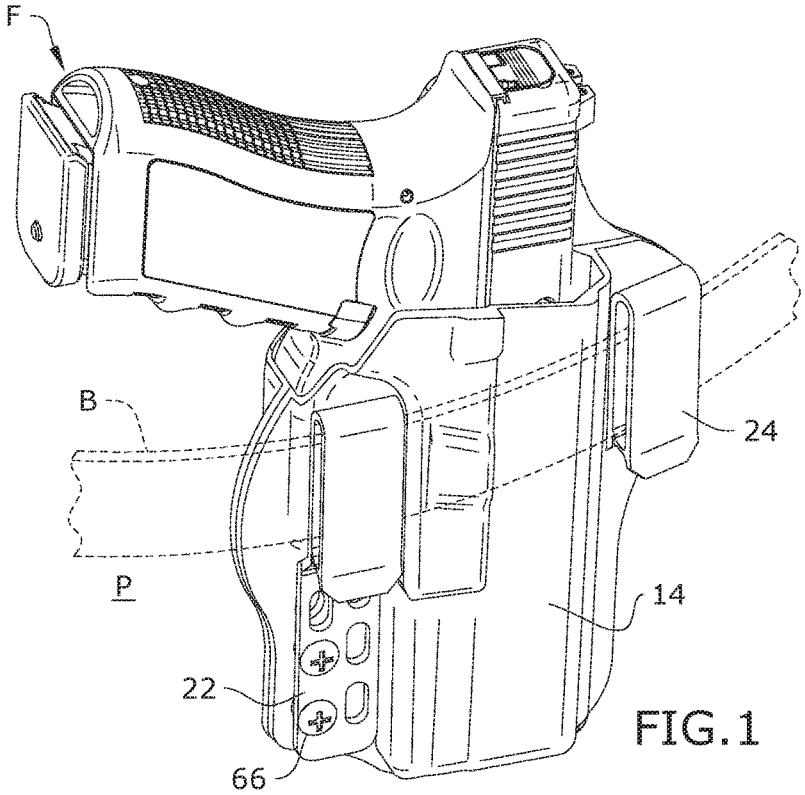
FIG. 1 shows a perspective side view of one embodiment of the present invention shown in use.
Figure 2:
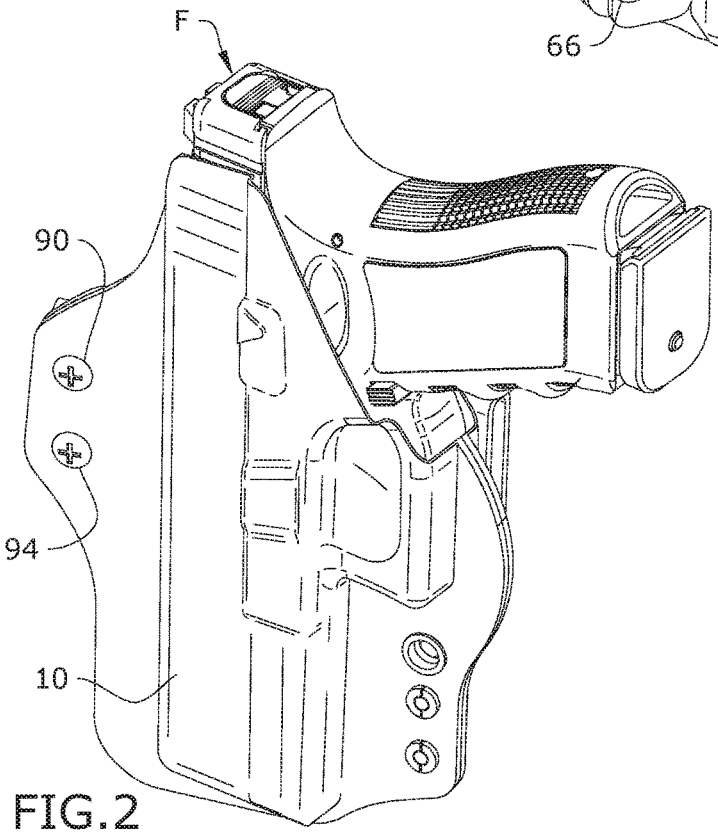
FIG. 2 shows a perspective side view of one embodiment of the present invention shown in use.
Figure 3:
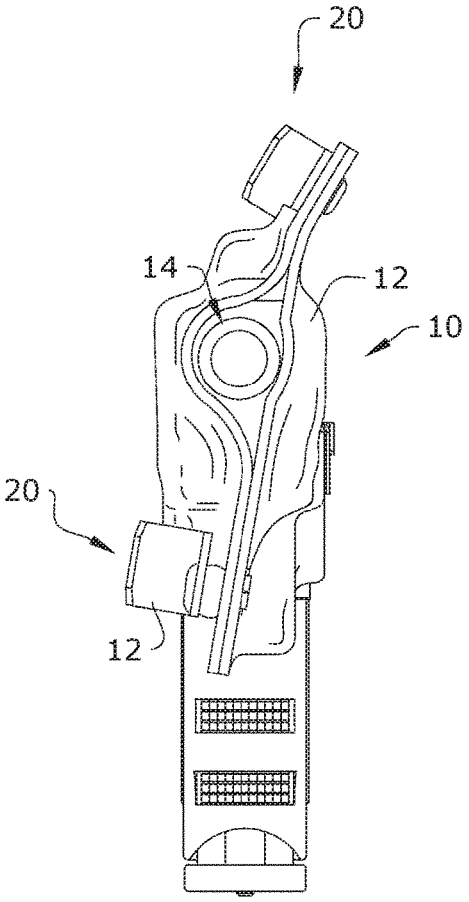
FIG. 3 shows a bottom view of one embodiment of the present invention.
Figure 4:
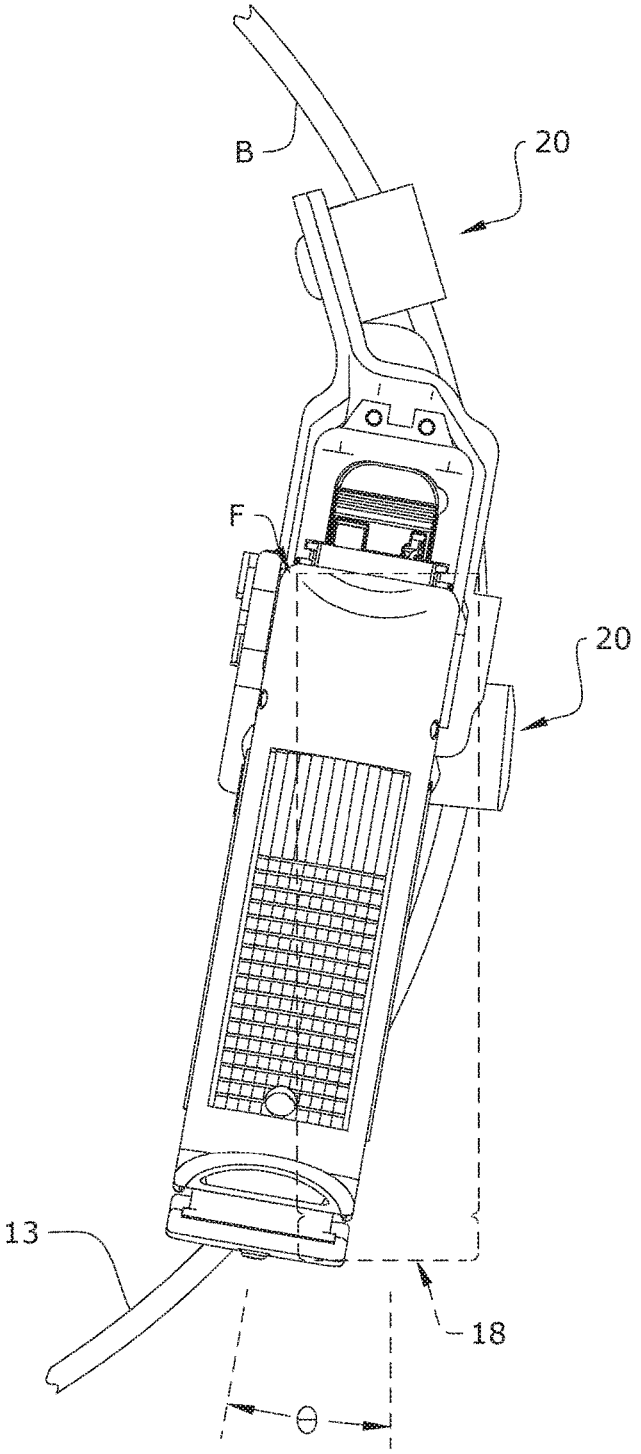
FIG. 4 shows a top view of one embodiment of the present invention shown in use.
Figure 5:
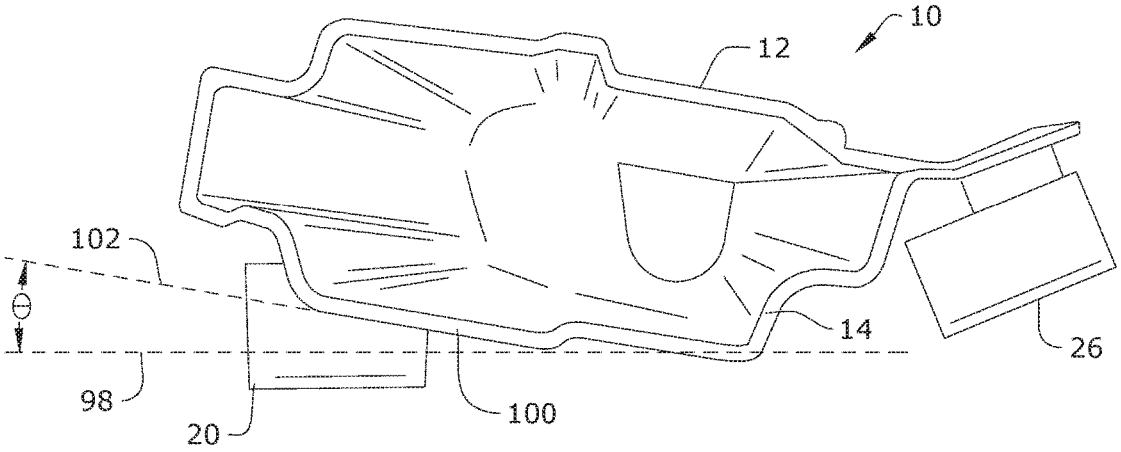
FIG. 5 shows a top view of one embodiment of the present invention.
Figure 6:
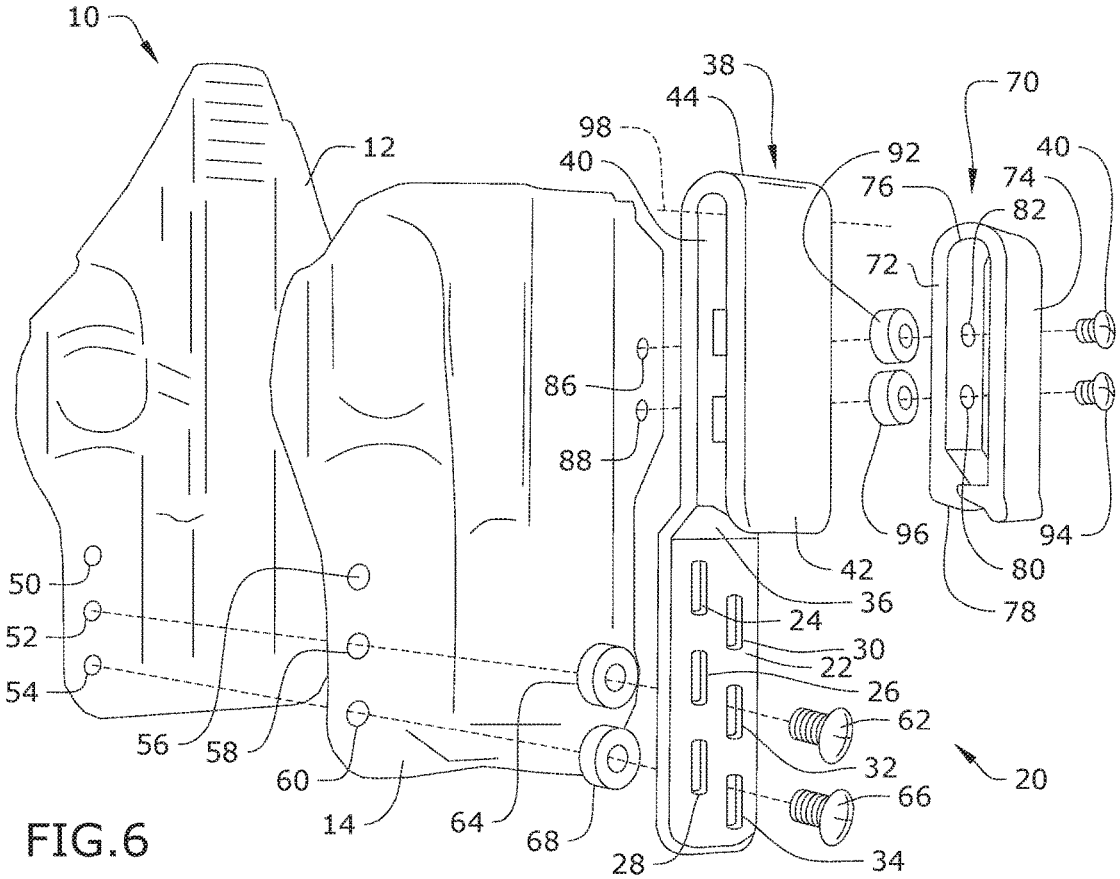
FIG. 6 shows an assembly view of one embodiment of the present invention.

By way of example, and referring to FIGS. 1-6, one embodiment of a holster assembly 10 further comprises a holster inner portion 12 that is adapted to align with a holster outer portion 14.

A first clip 20 further comprises a first clip lower portion 22. The first clip lower portion 22 further comprises a first lower clip first attachment slot 24, a first lower clip second attachment slot 26, a first lower clip third attachment slot 28, a first lower clip fourth attachment slot 30, a first lower clip fifth attachment slot 32, and a first lower clip sixth attachment slot 34. Note that the first lower clip first attachment slot 24, the first lower clip second attachment slot 26, the first lower clip third attachment slot 28 are parallel and collinear to one another. Likewise, the first lower clip fourth attachment slot 30, the first lower clip fifth attachment slot 32, and the first lower clip sixth attachment slot 34 are parallel and collinear to one another.

The first clip lower portion 22 is mechanically coupled to a first clip transition portion 36. Note that the first clip transition portion 36 extends outward from the first clip lower portion 22. In this arrangement outward is defined as away from outer portion 14. The first clip transition portion 36 is attached to a first clip upper portion 38. The first clip upper portion 38 further comprises a first clip upper portion inner portion 40 joined to a first clip upper portion outer portion 42 with a first clip upper portion top portion 44.

Note that the first clip lower portion 22, the first clip upper portion inner portion 40 and the first clip upper portion outer portion 42 are each approximately shaped like a parallelepiped and each parallelepiped further comprises a central axis. The first clip lower portion central is parallel to but not collinear with the first clip upper portion inner portion parallel axis and the first clip upper portion outer portion parallel axis.

The holster inner portion 12 further comprises an inner portion first attachment hole 50, an inner portion second attachment hole 52 and an inner portion third attachment hole 54. The holster outer portion 14 further comprises an outer portion first attachment hole 56, an outer portion second attachment hole 58 and an outer portion third attachment hole 60.

To attach the holster inner portion 12 to the holster outer portion 14, a first screw 62 can be inserted through the first lower clip sixth attachment slot 34, a second grommet 68, the outer portion second attachment hole 58 and the inner portion second attachment hole 52. Similarly, a second screw 66 can be inserted through the first lower clip fifth attachment slot 32, a first grommet 64, the outer portion third attachment hole 60 and the inner portion third attachment hole 54.

A second clip 70 further comprises a second clip inner portion 72. The second clip inner portion 72 is connected to a second clip outer portion 74 with a second clip rounded portion 76. The second clip inner portion 72 is mechanically coupled to a second clip wedge portion 78 and further comprises a first inner portion hole 80, a second inner portion hole 81, a third inner portion hole 82 and a fourth inner portion hole 83. The second clip outer portion 74 further comprises a second clip ledge 84 extending inward from the second clip outer portion 74 toward the second clip inner portion 72.

The holster outer portion 14 further comprises a third hole 86 and a fourth hole 88. To attach the holster inner portion 12 to the holster outer portion 14, a third screw 90 can be inserted through the third inner portion hole 82, a third grommet 92 the third hole 86 and into the holster inner portion 12. Then, a fourth screw 94 can be inserted through the first inner portion hole 80, a fourth grommet 96 the fourth hole 88 and into the holster inner portion 12.

The first clip upper portion top portion 44 is defined as having the shape of an arc that is extruded along a top portion central axis 98. The holster outer portion 14 is defined as having an outer wall 100 that is defined by an outer wall axis 102. An angle θ is measured counter clockwise from the top portion central axis 98 to the outer wall axis 102. It is critical that the angle θ be at least five degrees and no more than 15 degrees. Preferably the angle θ is about 10 degrees. This enables firearm F to fit inside the pants P of a user. First clip 20 and second clip 70 can fit over the belt B of the user and into the pants of the user.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A holster assembly, configured to be worn on a belt, the holster assembly comprising:

a holster inner portion, joined to a holster outer portion;

a first clip, joined to the holster inner portion and the holster outer portion; wherein the first clip is configured to be attached to the belt; wherein the first clip further comprises a first clip lower portion, being planar and mechanically coupled to a first clip transition portion which is planar and angled upwardly away from the holster outer portion; the first clip lower portion further comprising a horizontal outer wall axis when viewed from above;

a first clip upper portion, being planar and mechanically coupled to the first clip transition portion;

a first clip upper portion top portion, arranged on the first clip upper portion, forming a channel between a first clip upper portion inner portion and a first clip upper portion outer portion; a top of the channel forming a top portion central axis;

wherein an angle, when viewed from above and measured counterclockwise from the top portion central axis to the outer wall axis is at least five degrees but no more than fifteen degrees.

2. The holster assembly of claim 1, wherein the first clip upper portion further comprises: a first clip upper portion inner portion joined to a first clip upper portion outer portion with the first clip upper portion top portion.

3. The holster assembly of claim 1, wherein the first clip lower portion further comprises: a first lower clip first attachment slot, a first lower clip second attachment slot, a first lower clip third attachment slot, a first lower clip fourth attachment slot, a first lower clip fifth attachment slot, and a first lower clip sixth attachment slot.

4. The holster assembly of claim 3, wherein the first lower clip first attachment slot, the first lower clip second attachment slot, and the first lower clip third attachment slot are parallel and collinear to one another.

5. The holster assembly of claim 4, wherein the first lower clip fourth attachment slot, the first lower clip fifth attachment slot, and the first lower clip sixth attachment slot are parallel and collinear to one another.

6. The holster assembly of claim 5, wherein the first clip transition portion extends outward from the first clip lower portion.

7. The holster assembly of claim 5, wherein the first clip upper portion further comprises a first clip upper portion inner portion joined to a first clip upper portion outer portion with the first clip upper portion top portion.

* * * * *